United States Patent [19]

Wright

[11] Patent Number: 4,829,721

[45] Date of Patent: May 16, 1989

[54] HONING APPARATUS FOR BUN SLICING MACHINES

[75] Inventor: Stephen C. Wright, Bettendorf, Iowa

[73] Assignee: Hansaloy Corporation, Davenport, Iowa

[21] Appl. No.: 96,036

[22] Filed: Sep. 14, 1987

[51] Int. Cl.[4] ..... B24B 19/00

[52] U.S. Cl. ..... 51/246; 51/DIG. 18; 83/174

[58] Field of Search ..... 51/246, 204, 211 R, 51/211 H, 250, 74 BS, 80 BS, 98 BS, 98.5, 59 R, 67, DIG. 18; 83/174, 174.1, 425

[56] References Cited

U.S. PATENT DOCUMENTS 2,961,809 11/1960 Hansen ..... 51/DIG. 18

*Primary Examiner*—Frederick R. Schmidt

*Assistant Examiner*—Maurina Rachuba

*Attorney, Agent, or Firm*—James C. Nemmers

[57] ABSTRACT

An apparatus for honing in place the endless blades of a band-type slicer for buns and similar bakery goods. The honing apparatus has a pair of independently adjustable hones mounted on a common actuator so that the hones will simultaneously engage both sides of the cutting edge of the endless blade as it passes between the hones. The apparatus also uses a helical cam arrangement that advances and retracts the hones during the honing operation to lengthen the life of the hones and also to provide a more accurate honing as the hones and blades wear. Because of the mounting arrangement and the independent adjustability of the hones, the apparatus can be attached to and used with any of the various bun slicing machines that are presently commerically available.

8 Claims, 2 Drawing Sheets

HONING APPARATUS FOR BUN SLICING MACHINES

BACKGROUND OF THE INVENTION

This invention relates to an apparatus for honing the endless band that is used in slicing buns and similar bakery goods.

As is well known in the bakery industry, there are machines commercially available and used for performing the slicing function of bakery goods. Bread slicing machines generally employ multiple endless bands that are driven in vertical planes and are spaced-apart the distance of the desired thickness of a slice of bread. The bands are driven so that their cutting edges face the loaf of bread as it travels down a conveyor, and as the loaf passes through the multiple bands, the loaf is cut into the desired number of slices. After a period of time, the blades will become slightly dulled, and it is essential that they be maintained in a sharpened condition so as to cleanly and effectively cut the freshly baked bread before the bread is packaged. Therefore, there have been designed honing attachments which will periodically hone the blades in place while they are operating at their normal speeds. These hones have been designed to simultaneously hone both sides of the blades. An example of such a honing apparatus is shown in Hansen U.S. Pat. No. 3,060,650 which discloses apparatus for honing both sides of multiple blades of a bread slicing machine simultaneously while the blades are running at their normal speed. This particular apparatus, however, requires two separate hones each of which is independently mounted and independently actuated so as to engage the opposite sides of the blade. Earlier versions of honing apparatus for bread slicing machines are shown in U.S. Pat. Nos. 2,997,825 and 2,961,809. In the case of the production of buns, such as hamburger buns and the like, the slicing operation is commonly done using a single endless blade that is driven in a horizontal plane and which is positioned in the path of the buns traveling horizontally on a conveyor. Because these machines employ only a single slicing blade, they are in many respects simpler than bread slicing machines. However, the problem of honing the blade while the blade is operating at its normal speed still exists. Because there are a variety of different bun slicing machines commercially available, they differ sufficiently that there has not been designed a honing apparatus that can be attached to an used with all of these machines. In fact, for whatever reason, there is not available an effective honing apparatus for a bun slicing machine, especially an apparatus that will hone both sides of the blade simultaneously.

Because honing of the blade will increase its useful life substantially, there is therefore a need for a honing apparatus for bun slicing machines, especially such an apparatus that can be used with the variety of machines commercially available. Such an apparatus would have to provide sufficient adjustability to adapt it to the different designs of bun slicing machines that are available, and should also be one that is relatively simple and low in cost. It is therefore the primary object of the invention to provide a honing apparatus for honing the blades of bun slicing machines by honing both sides of the blades simultaneously. It is a further object of the invention to provide such an apparatus that is easily adaptable to any of the commercially available bun slicing machines.

SUMMARY OF THE INVENTION

The apparatus of the invention consists of a pair of rod-like hone stones which are mounted on a single support but are individually adjustable. The support for the hones is operatively connected to a helical cam which will advance and retract the hones along generally axial lines. The helical cam is driven by a motor that is intermittently operated, and the motor also drives a gear containing an actuator which will cause the entire apparatus to move into and out of a position where the hones are engageable with the traveling blade. Thus, the entire operation is automatic, and because of the individual adjustability of the hones, the honing apparatus can be added as an attachment to any bun slicing machine.

DESCRIPTION OF THE PREFERRED EMBODIMENT OF THE INVENTION

Figure 1:
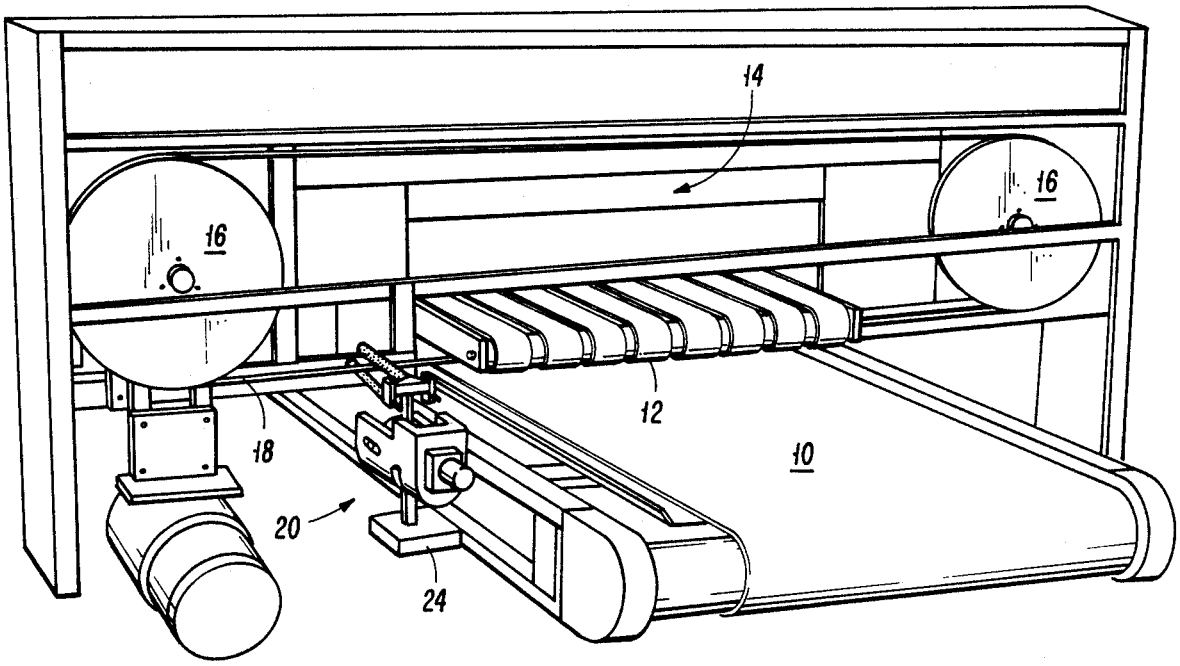
FIG. 1 is a perspective view of a portion of a bun slicing machine and showing the apparatus of the invention mounted in position relative to the slicing blade.
Figure 2:
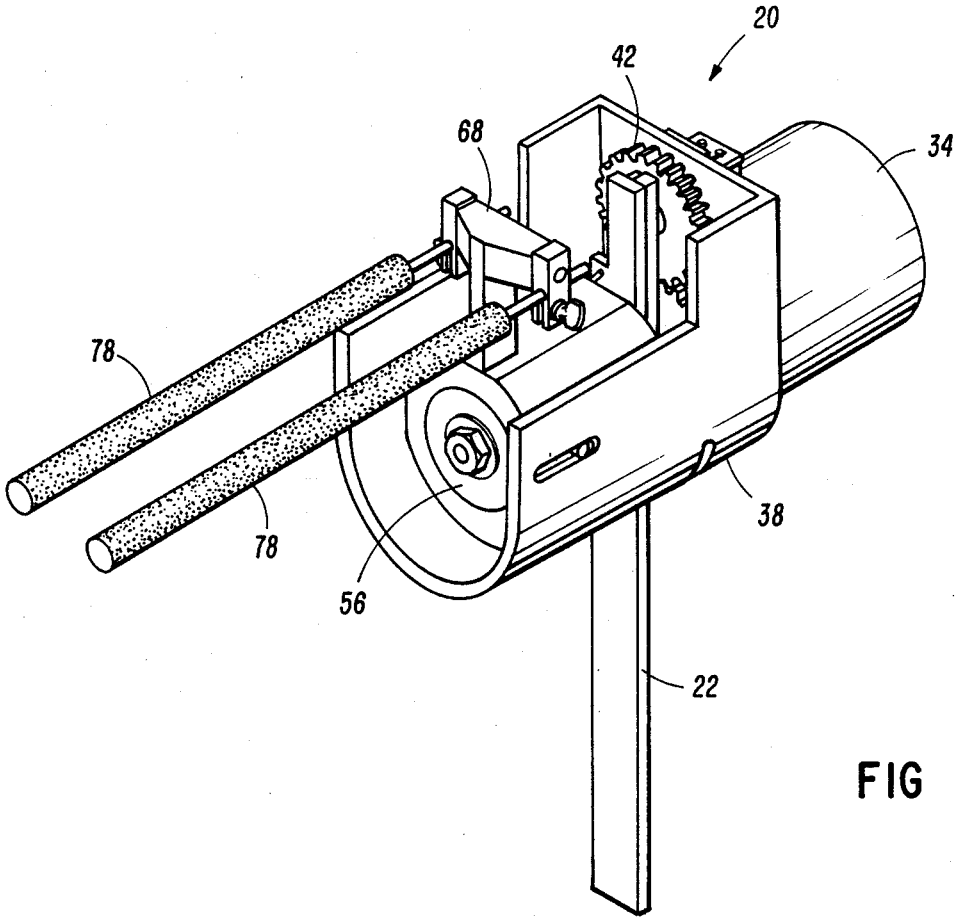
FIG. 2 is a perspective view of the honing apparatus of the invention.

In FIG. 1, there is illustrated a typical bun slicing machine which includes a conveyor 10 upon which the buns rest and are conveyed usually in rows of six each. The bun slicer includes upper belts which hold the buns during the slicing operation, the upper belts 12 being positioned beneath the slicer head indicated generally by the reference numberal 14. The slicer head includes a pair of spaced-apart drums 16, one on each side of the conveyor 10, which drums 16 are rotatable about horizontal axes in a plane transverse to the direction travel of the conveyor 10. The drums 16 support an endless band 18 which typically has a sharpened and serrated edge along its entire length, the edge facing the buns as they travel down the conveyor 10 beneath the slicer head 14. As illustrated in FIG. 1, the band 18, which is the slicing blade, travels in a horizontal plane with the lower loop running between the conveyor 10 and the upper belts 12 at the desired height so as to slice the buns at the proper place.

The slicing blades 18 commonly have scalloped edges to form teeth. Depending upon the particular blade, the blade edge is cut to an angle of approximately 5° and thus the hone must be positioned at precisely that angle relative to the blade 18. The honing apparatus of the invention is therefore designed so it can be positioned with the hones adjusted to the proper angle to perform the honing operation regardless of the particular slicing machine. To achieve this, the honing apparatus of the invention, which is indicated generally by the reference numberal 20, is provided with a main support arm 22 which will be secured in any suitable manner to a stationary portion of the framework of the bun slicing machine. In FIG. 1, the honing apparatus 20 is shown as being mounted on the side rails of the conveyor 10, with the support arm 22 secured in a supporting bracket 24 that in turn is affixed to the framework of conveyor 10.

Figures 3, 4:
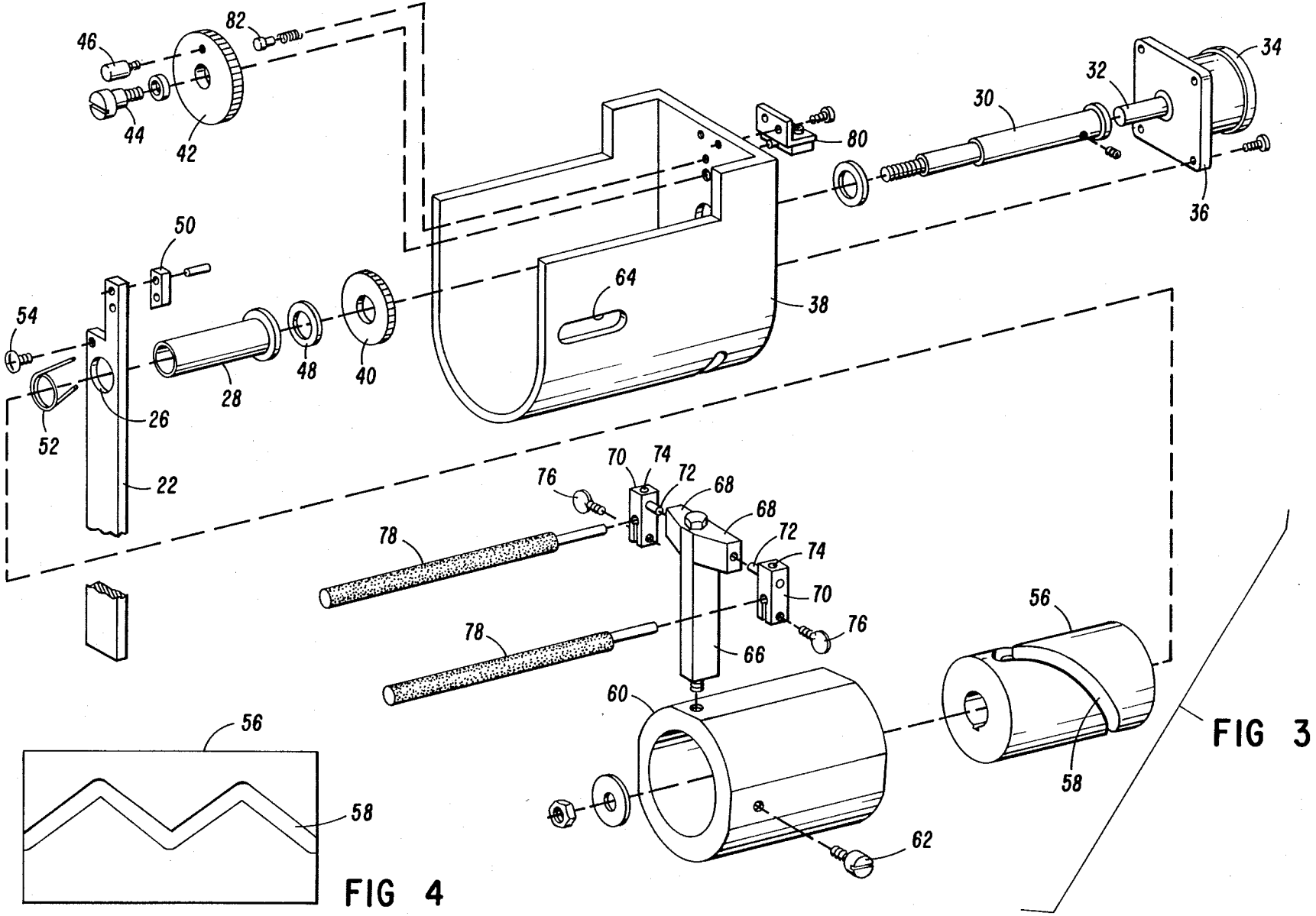
FIG. 3 is an exploded perspective view of the honing apparatus of the invention.
FIG. 4 is a flat plan view of the helical cam component of the honing apparatus.

As best seen in FIG. 3, the support arm 22 has a transverse opening 26 near its upper end so as to receive a sleeve 28 through which extends the shaft 20 which in turn is operatively connected to the drive shaft 32 of motor 34. Motor 34 is mounted on plate 36 which in turn is secured to the housing 38.

Shaft 30 also has operatively connected to it a drive spur gear 40 which is engaged with a larger driven spur gear 42 rotatable on shaft 44 secured to the housing 38 directly above shaft 20. The axis of shaft 44 is parallel to the axis of shaft 30, and the driven gear 42 has extending from its face a cam driver 46. As best seen in FIG. 3, the main support arm 22 is spaced axially from drive gear 42 by means of a bushing 48, and the upper end of the main support arm 22 has affixed to it or formed intergally with it a follower 50 that is intermittently engageable with the cam driver 46. The cam driver 46 is positioned radially on driven gear 42 so that as gear 42 rotates the cam driver 46 will engage the follower 50. When this occurs, the housing 38 will pivot about the axis of shaft 30 relative to the support arm 22. Then, as the driven gear 42 continues to rotate, the cam driver 46 will become disengaged from follower 50 thus allowing the housing 38 to return to its original position. Housing 38 is biased to its normal original position by means of the spring 52 that is looped around the sleeve 28 and which has one arm engageable with the inside surface of housing 38 and the other arm engageable with stop 54 secured to the support arm 22. Stop 54 may be located in multiple positions to provide different spring forces and thus increase or decrease the pressure of the hone stones on the slicer blade. This pivoting action of the housing 38 relative to the support arm 22 provides for engagement and disengagement of the hones with the slicing blade 18 in the manner more fully described hereinafter.

As best seen in FIG. 3, a helical cam 56 is keyed or otherwise affixed to shaft 20 and has formed in its outer surface a helical groove 58. Annular member 60 receives the helical cam 56 and contains a follower 62 the inner end of which engages in the groove 58 of the helical cama 56. The outer end of follower 62 is engageable in an elongated horizontal slot 64 formed in one side of housing 38. Thus, as the helical cam 56 rotates, being driven by shaft 30, the annular member 60 will move axially a predetermined distance in one direction and then return, being restrained from turning by engagement of the follower 62 in slot 64. The extent of axial movement of the annular member 60 is of course determined by the specific design of the helical groove 58 and the length of the slot 64.

A vertical support 66 is secured to the annular member 60, and has a pair of outwardly extending arms 68 at its upper end. At the outer end of each arm is a hone support member 70 each of which is connected to its respective arms 68 by a small support shaft 72. Thus, the support member can turn on shaft 72 and then be locked in a selected position by means of a set screw 74 or other suitable means. Each hone support member 70 also has an opening extending through it, which opening extends transversely to the shaft 72, and the lower end of each support member 70 is preferably bifurcated and threaded member 76 extendings through the bifurcated lower end of the support member 70. The pair of stones 78 have their mounting ends each extending into the openings in the lower ends of the support members 70, and by tightening the threaded member 76, the rod-like stones can be turned as well as moved lengthwise. With this mounting arrangement, it will be seen that the stones 78 can be adjusted lengthwwise, turned, and their angle relative to shaft 30 varied by loosening the set screws 74 and turning the support members 70 on shaft shaft 72 after which the set screw 74 is tightened to maintain the stone in the desired selected position.

Because the hones are mounted on a single support and are moveable with annular member 60, the stones 78 will be moved back and forth along their lengths whenever the helical cam 56 is rotated because of the design of the helical cam 56 as shown in FIG. 4 which is a flat plan of the helical groove 58. The hones will be extended and retracted twice during a single revolution of the helical cam 56.

As previously described, the honing apparatus of the invention is mounted on a fixed portion of the bun slicing machine and positioned so that the stones 78 are near the slicing blade 18, with the slicing blade passing through the space between the two stones 78 but not engaging them. In this position, the cam driver 46 is disengaged from the follower 50 on the support arm 22, and the spring 52 will bias the housing 38 into a tilted position relative to the vertical axis of the support arm 22. In this position, the stones 78 will not be in a horizontal plane but rather will lie in a plane at an angle from the horizontal and thus at an angle from the plane of travel of the slicing blade 18 thus permitting the slicing blade 18 to pass between the stones 78 without engaging them. When the operator desires to peform the honing operation, the motor 34 is started. As shaft 30 rotates, the helical cam 56 will rotate causing the annular member 60 to move axially outwardly and return. Then, as the driven gear 42 rotates, the cam driver 46 will engage the follower 50 on the support arm 22 forcing the entire housing 38 to pivot about the axis of shaft 30. Obviously, as housing 38 pivots, it will carry with it the annular member 60 and the stones 78. The angle of pivot is sufficient to cause the stones 78 to engage opposite sides of the slicing blade 18. Assuming the stones are properly adjusted at the proper angles, the cutting edge of the slicing blade 19 will be accurately honed. The honing apparatus of the invention of course provides for adjustability of the stones 78 not only as to their angular position relative to the slicing blade 18, but also allows the stones to be positioned longitudinally and rotationally so that the life of the stones 78 will be greatly increased. Of course, the action of the helical cam 56 advancing and retracting the hones during the honing cycle also prolongs the life of the stones 78.

To simplify the use of the apparatus of the invention so that the operator need actuate the motor 34 once for ach honing cycle after which it will turn off, there is provided a switch 80 that has an actuator 82 engageable with driven gear 42 in a manner so that the motor 34 will be shut off after one complete revolution of driven gear 42. Depending upon the speed of the motor 34 and the ratio of the gears 40 and 42, a typical honing cycle in which the stones 78 are engaged wtih the slicing blade 18 might be 45 seconds.

From the foregoing description, it will be evident that the honing apparatus of the invention provides a universal attachment for bun slicing machines, and one in which a single apparatus can be utilized to hone both sides of the slicing blade. The apparatus is fully adjustable to sharpen blades of different cutting angles, and is fully automatic. The design of the honing apparatus of the invention also provides for adjustability of the hones so as to maximize their life. When the hones do need replacement, they can be easily and quickly replaced by merely loosening a single thumb screw and removing the hones and replacing them with new ones. The honing apparatus of the invention is also extremely simple and will require very little maintenance. Having thus described the apparatus of the invention in connection with a preferred embodiment of it, it will be evident to those skilled in the art that various revisions and modifications can be made to the embodiment described herein without departing from the spirit and scope of the invention. It is my intention however that all such revisions and modifications as are obvious to those skilled in the art will be included within the scope of the following claims.

What is claimed is:

1. A honing attachment for a slicing machine having an endless band with a cutting edge that provides a cutting blade, which blade travels in a single plane during a substantial portion of its path of travel, said attachment comprising a pair of spaced-apart elongated hones, a common support for said hones to position the hones one on each side of the blade as it travels in said single plane, said support providing for adjustable positioning of said hones independently of each other, said support also providing for adjustable positioning of the angle of each hone relative to said single plane of travel of the balde so as to hone the cutting edge at a desired predetermined angle, first means for moving said support to cause said hones selectively to move to and out of engagement with the cutting edge of the blade, and second means for moving said support so as to advance and retract said hones toward and away from the cutting edge of the blade during the time that the hones are engaged with the cutting edge of the blade.

2. The honing attachment of claim 1 in which the second means includes a member that is moveable back and forth in a direction generally parallel to the elongated hones, said support being carried by said member, and power means that provides for the controlled back and forth movement of said member.

3. The honing attachment of claim 2 in which said member is driven back and forth by a helical cam, said cam being turnable by said power means.

4. The honing attachment of claim 3 in which said first means includes a main support member adapted to be fixedly attached to the slicing machine, said attachment being pivotally mounted on said fixed main support member so as to be moveable in a manner that provides for engagement of the elongated hones with said blade when said attachment pivots.

5. A honing attachment for a slicing machine having an endless band with a cutting edge that provides a cutting blade which blade travels in a single plane during a substantial portion of its path of travel, said attachment comprising a main support member adapted to be fixedly attached to the machine, a housing mounted with respect to the main support member so as to be pivotable with respect thereto, a main shaft extending through said housing and providing the pivotable connection between the main support member and the housing, power means for rotating the shaft, a drive gear mounted on said shaft and rotatable therewith, a driven gear engageable with the drive gear and driven thereby, said driven gear being mounted on the housing for rotatable movement relative to the housing, a cam member secured to the driven gear near its outer periphery and engageable intermittently with the main support member in a manner that will cause pivotal movement of the housing relative to the main support member during the time that the cam member is engaged with the main support member, a pair of spaced-apart rod-like hones, a common support for said hones to position said hones one on each side of the blade as it travels in said single plane when the attachment is properly positioned by affixing the main support member to the machine, said common support providing for adjustable positioning of said hones independently of each other, said common support also providing for adjustable positioning of the angle of each hone relative to said single plane of travel of the blade so as to hone the cutting edge at a desired predetermined angle, means providing for movement of said common support member in a direction generally parallel to the rod-like hones so as to advance and retract said hones toward and away from the cutting edge of the blade during the time the hones are engaged with the blade, power means for rotating the main shaft, and switch means for controlling the power means.

6. The honing attachment of claim 5 in which the switch means has an actuator, and said actuator is engageable with the driven gear so as to shut off the power means after a predetermined cycle of operation.

7. The honing attachment of claim 5 in which the means for moving the common support includes a helical cam operatively connected to the main shaft, said helical cam being also operatively connected to the common support to advance and retract the common support.

8. The honing attachment of claim 7 in which the mounting of the rod-like hones provides for adjustment of the hones along their length as well as adjustability of the angle of each hone in a plane transverse to said single plane of travel of the blade, said adjustable common support also providing for turnable movement of each of the rod-like hones.

* * * * *